US010223977B2

(12) United States Patent
Hwang

(10) Patent No.: US 10,223,977 B2
(45) Date of Patent: Mar. 5, 2019

(54) CIRCUIT FOR SENSING THRESHOLD VOLTAGE AND DISPLAY DEVICE INCLUDING THE SAME

(71) Applicant: Dongbu HiTek Co., Ltd., Bucheon-si (KR)

(72) Inventor: Tae Ho Hwang, Uijeongbu-si (KR)

(73) Assignee: DB HiTek Co., Ltd., Seoul (KR)

( * ) Notice: Subject to any disclaimer, the term of this patent is extended or adjusted under 35 U.S.C. 154(b) by 58 days.

(21) Appl. No.: 15/620,580

(22) Filed: Jun. 12, 2017

(65) Prior Publication Data

US 2018/0190207 A1 Jul. 5, 2018

(30) Foreign Application Priority Data

Dec. 30, 2016 (KR) ..... 10-2016-0183720

(51) Int. Cl.
*G09G 5/00* (2006.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2310/0286* (2013.01); *G09G 2310/0289* (2013.01); *G09G 2310/0291* (2013.01); *G09G 2310/0294* (2013.01); *G09G 2310/0297* (2013.01); *G09G 2320/0233* (2013.01); *G09G 2330/02* (2013.01)

(58) Field of Classification Search
CPC ... G09G 2310/0291; G09G 2310/0294; G09G 2310/0297; G09G 2310/0286; G09G 2310/0289; G09G 2320/0233; G09G 2320/045; G09G 2330/02; G09G 2330/12; G09G 3/3233; G09G 3/3266; G09G 3/3291
See application file for complete search history.

(56) References Cited

U.S. PATENT DOCUMENTS

2014/0368415 A1* 12/2014 Kim ..... G09G 3/3233 345/77
2015/0091888 A1* 4/2015 Min ..... G09G 3/3291 345/212

* cited by examiner

*Primary Examiner* — Insa Sadio
(74) *Attorney, Agent, or Firm* — Andrew D. Fortney; Central California IP Group, P.C.

(57) ABSTRACT

A circuit configured to sense a threshold voltage of an organic light emitting diode (OLED) of a display panel includes a sample and hold unit configured to receive the threshold voltage of the OLED, a first capacitor configured to sample the threshold voltage of the OLED, a second capacitor configured to charge-share the voltage on the first capacitor, an output terminal configured to output the voltage on the second capacitor, and an amplifier including an input terminal connected to the output terminal of the sample and hold unit. The sample and hold unit includes a first switching unit configured to selectively connect the OLED, the first capacitor, the second capacitor, the first capacitor and a first or second reference voltage, the second capacitor and the second or a third reference voltage, and the second capacitor and the output terminal.

20 Claims, 6 Drawing Sheets

CIRCUIT FOR SENSING THRESHOLD VOLTAGE AND DISPLAY DEVICE INCLUDING THE SAME

This application claims the benefit of Korean Patent Application No. 10-2016-0183720, filed on Dec. 30, 2016, and may be related to U.S. patent application Ser. No. 15/657,622, filed on Jul. 24, 2017, which are hereby incorporated by reference as if fully set forth herein.

BACKGROUND OF THE INVENTION

Field of the Invention

Embodiments of the present invention relate to a circuit configured to sense a threshold voltage and a display device including the same.

Discussion of the Related Art

Pixels of a display device using organic light emitting diodes (OLEDs) are turned on by data signals supplied from data lines to generate light when the data signals are supplied to gate lines of the OLEDs.

OLEDs having unique colors (e.g., red, green and blue) may form a unit pixel of a display panel, and a desired color may be implemented by a combination of the colors of the unit pixels.

The OLEDs of the display panel may gradually deteriorate with the passage of time, thereby changing threshold voltages. Thus, when the same driving signal is supplied to the OLED, the brightness of the OLED may change with the passage of time. Accordingly, there is a need for a compensation process to enable the OLED to emit light with constant brightness, regardless of any change in threshold voltage of the OLED with the passage of time.

SUMMARY OF THE INVENTION

Accordingly, embodiments of the present invention are directed to a circuit configured to sense a threshold voltage, which is capable of reducing an offset caused by a parasitic capacitor (e.g., of a sample and hold circuit) and/or improve reliability and sensitivity related to sensing a threshold voltage of an organic light emitting diode (OLED), and a display device including the same.

Additional advantages, objects, and features of the invention will be set forth in part in the description which follows and in part will become apparent to those skilled in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose(s) of embodiments of the invention, as embodied and broadly described herein, a circuit configured to sense a threshold voltage of an organic light emitting diode (OLED) of a display panel may include a first sample and hold unit having a first input terminal configured to receive the threshold voltage of the OLED, a first capacitor configured to sample the threshold voltage of the OLED, a second capacitor configured to charge-share a voltage on or from the first capacitor and a first output terminal configured to output a voltage on or from the second capacitor, and an amplifier including a first amplifier input terminal connected to the first output terminal of the first sample and hold unit. The first sample and hold unit includes a first switching unit configured to selectively connect and disconnect the first input terminal and a first terminal of the first capacitor, the first terminal of the first capacitor and a first terminal of the second capacitor, a second terminal of the first capacitor and a first reference voltage, the second terminal of the first capacitor and a second reference voltage, a second terminal of the second capacitor and the second reference voltage, the first terminal of the second capacitor and a third reference voltage, and the second terminal of the second capacitor and the first output terminal.

The first switching unit may further include a first switch between the first input terminal and the first terminal of the first capacitor, a second switch between the first terminal of the first capacitor and the first terminal of the second capacitor, a third switch between the second terminal of the first capacitor and the first reference voltage, a fourth switch between the second terminal of the first capacitor and the second reference voltage, a fifth switch between the second terminal of the second capacitor and the second reference voltage, a sixth switch between the first terminal of the second capacitor and the third reference voltage, and a seventh switch between the second terminal of the second capacitor and the first output terminal.

The second reference voltage may be less than the third reference voltage.

The circuit may further include a second sample and hold unit including a second input terminal connected to the first reference voltage, a third capacitor, a fourth capacitor, a second output terminal and a second switching unit configured to selectively connect and disconnect the second input terminal and a first terminal of the third capacitor, the first terminal of the third capacitor and a first terminal of the fourth capacitor, a second terminal of the third capacitor and the first reference voltage, the second terminal of the third capacitor and the second reference voltage, either terminal of the fourth capacitor and the second reference voltage, the first terminal of the fourth capacitor and a fourth reference voltage, and the second terminal of the fourth capacitor and the second output terminal.

The second switching unit may include an eighth switch between the second input terminal and the first terminal of the third capacitor, a ninth switch between the first terminal of the third capacitor and the first terminal of the fourth capacitor, a tenth switch between the second terminal of the third capacitor and the first reference voltage, an eleventh switch between the second terminal of the third capacitor and the second reference voltage, a twelfth switch between the first terminal of the fourth capacitor and the fourth reference voltage, a thirteenth switch between the second terminal of the fourth capacitor and the second reference voltage, and a fourteenth switch between the second terminal of the fourth capacitor and the second output terminal.

The amplifier may further include a second amplifier input terminal connected to the second output terminal, and the first and second amplifier output terminals, wherein the amplifier is configured to amplify signals on the first and second amplifier input terminals and output an amplified signal on the first and second amplifier output terminals.

The amplifier may further include a first feedback capacitor between the first amplifier input terminal and the first amplifier output terminal and a second feedback capacitor between the second amplifier input terminal and the second amplifier output terminal.

The circuit may further include an analog-to-digital converter configured to convert the amplified signal to a digital signal.

The circuit may further include a memory configured to store the digital signal.

A capacitance of the first capacitor may be equal to a capacitance of the third capacitor, and a capacitance of the second capacitor may be equal to a capacitance of the fourth capacitor.

The first and third switches and the eighth and tenth switches may be configured to be connected and disconnected simultaneously, the second, fourth, sixth, ninth, eleventh and thirteenth switches may be configured to be connected and disconnected simultaneously, and the fifth and seventh switches and the eleventh and fourteenth switches may be configured to be connected and disconnected simultaneously.

The first and second sample and hold units may be configured to sample the threshold voltage of the OLED by (i) connecting the first switch, the third switch, the eighth switch and the tenth switch and (ii) disconnecting the second switch, the fourth to seventh switches, the ninth switch and the eleventh to fourteenth switches.

The first and second sample and hold units may further be configured to share a voltage on the first and third capacitors by (i) connecting the second and ninth switches, the fourth and eleventh switches and the sixth and thirteenth switches and (ii) disconnecting the first and eighth switches, the third and tenth switches and the fifth and twelfth switches and the seventh and fourteenth switches.

The first and second sample and hold units may further be configured to transfer or deliver a signal to the first and second output terminals by (i) connecting the fifth and twelfth switches and the seventh and fourteenth switches and (ii) disconnecting the first to fourth switches, the eighth to eleventh switches and the sixth and thirteenth switches.

According to another aspect of the present invention, a circuit configured to sense a threshold voltage of an organic light emitting diode (OLED) of a display panel includes a first input terminal configured to receive a threshold voltage of the OLED, a first capacitor configured to sample the threshold voltage of the OLED, a second capacitor configured to charge-share a voltage on or from the first capacitor, a first output terminal configured to output a voltage on or from the second capacitor, a first switching unit configured to selectively connect and disconnect the first input terminal and a first terminal of the first capacitor, the first terminal of the first capacitor and a first terminal of the second capacitor, a second terminal of the first capacitor and a first reference voltage, the second terminal of the first capacitor and a second reference voltage, a second terminal of the second capacitor and the second reference voltage, the first terminal of the second capacitor and a third reference voltage, and the second terminal of the second capacitor and the first output terminal, and an amplifier including a first input terminal connected to the first output terminal.

According to yet another aspect of the present invention, a display device includes a display panel including (i) a plurality of unit pixels and (ii) a plurality of gate lines and a plurality of data lines connected to the plurality of unit pixels, each unit pixel respectively including an organic light emitting diode (OLED) and a source driver including a threshold voltage sensing circuit configured to sense a threshold voltage of each of the plurality of OLEDs. The threshold voltage sensing circuit includes a plurality of sample and hold circuits configured to sample and hold the threshold voltage of each of the plurality of OLEDs through the data lines, and an amplifier configured to amplify output of the sample and hold circuits. Each of the plurality of sample and hold circuits includes a first sample and hold unit including a first input terminal connected to one of the data lines, a first capacitor configured to sample the threshold voltage of the OLED, a second capacitor configured to charge-share a voltage on or from the first capacitor, a first output terminal configured to output a voltage on or from the second capacitor, and a first switching unit, and the amplifier includes a first input terminal connected to the first output terminal. The first switching unit is configured to selectively connect and disconnect the first input terminal and a first terminal of the first capacitor, the first terminal of the first capacitor and a first terminal of the second capacitor, the second terminal of the first capacitor and a first reference voltage, the second terminal of the first capacitor and a second reference voltage, a second terminal of the second capacitor and the second reference voltage, the first terminal of the second capacitor and a third reference voltage, and the second terminal of the second capacitor and the first output terminal.

The first switching unit may include a first switch between the first input terminal and the first terminal of the first capacitor, a second switch between the first terminal of the first capacitor and the first terminal of the second capacitor, a third switch between the second terminal of the first capacitor and the first reference voltage, a fourth switch between the second terminal of the first capacitor and the second reference voltage, a fifth switch between the second terminal of the second capacitor and the second reference voltage, a sixth switch between the first terminal of the second capacitor and the third reference voltage, and a seventh switch between the second terminal of the second capacitor and the first output terminal.

The threshold voltage sensing circuit may further include a multiplexer configured to select one of the plurality of sample and hold circuits and to provide an output of the selected sample and hold circuit to a first input terminal of the amplifier.

The threshold voltage sensing circuit may further include an analog-to-digital converter configured to convert a signal from the amplifier to a digital signal and a memory configured to store the digital signal.

The threshold voltage sensing circuit may further include a primary second sample and hold unit and a secondary second sample and hold unit, and each of the primary and secondary second sample and hold units may include a second input terminal connected to the first reference voltage, a third capacitor and a fourth capacitor, a second output terminal and a second switching unit is configured to selectively connect and disconnect the second input terminal and a first terminal of the third capacitor, the first terminal of the third capacitor and a first terminal of the fourth capacitor, a second terminal of the third capacitor and the first reference voltage, the second terminal of the third capacitor and the second reference voltage, a second terminal of the fourth capacitor and the second reference voltage, the first terminal of the fourth capacitor and a fourth reference voltage, and the second terminal of the fourth capacitor and the second output terminal.

It is to be understood that both the foregoing general description and the following detailed description of embodiments of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle(s) of the invention. In the drawings.

DETAILED DESCRIPTION OF THE INVENTION

Figure 1:
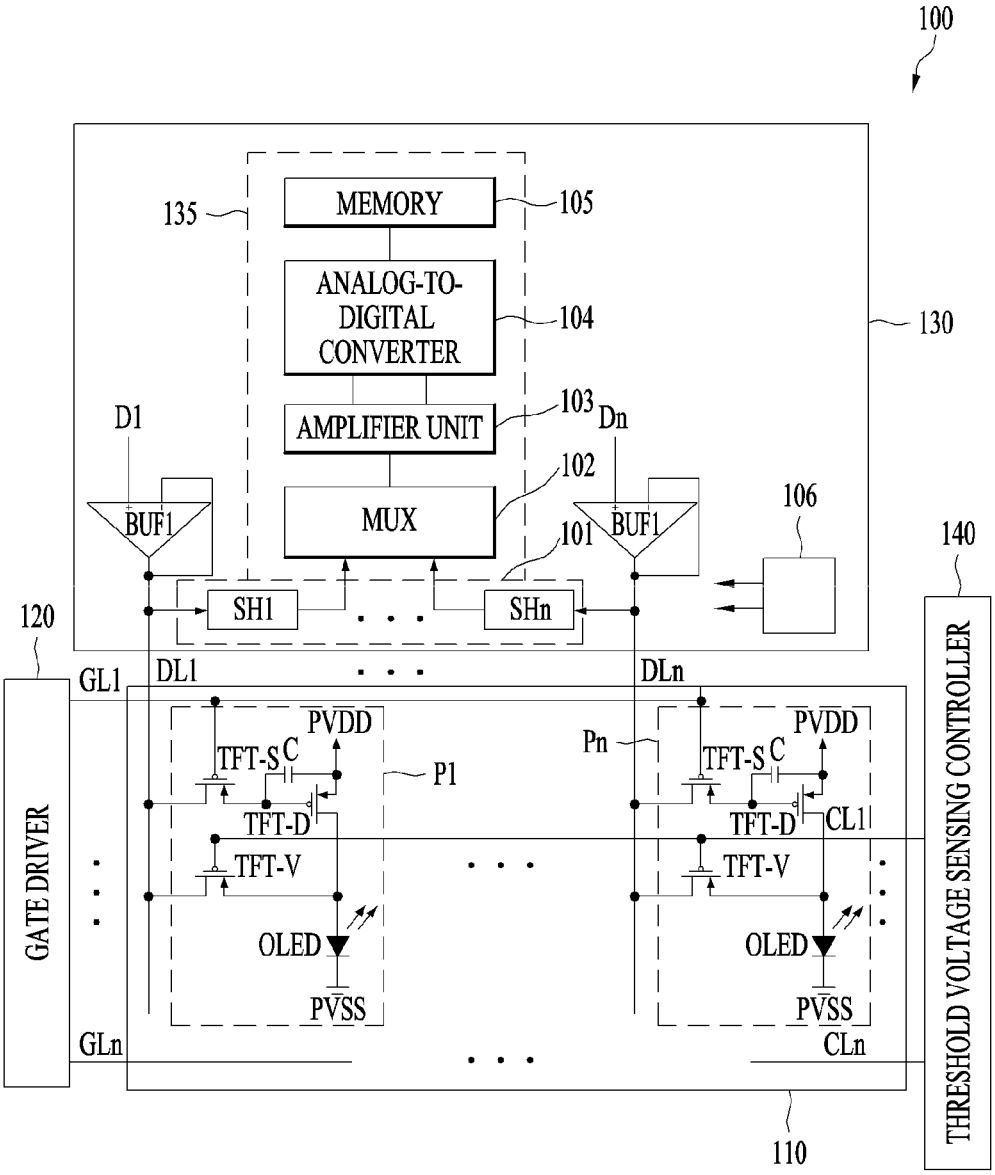
FIG. 1 is a diagram showing an exemplary configuration of a display device according to one or more embodiments of the present invention.

Hereinafter, embodiments of the present invention will be described with reference to the accompanying drawings.

In description of the embodiments, it will be understood that, when an element such as a layer, film, region, pattern or structure is referred to as being formed "on" or "under" another element, such as a substrate, layer (film), region, pad or pattern, it can be directly "on" or "under" the other element or be indirectly "on" or "under" the other element with intervening elements therebetween. It will also be understood that "on" and "under" the element is described relative to the drawings.

In addition, the relative terms "first" and "second", "top/upper/above", "bottom/lower/under" and the like in the description and claims may be used to distinguish between any one substance or element and other substances or elements and not necessarily for describing any physical or logical relationship between the substances or elements or a particular order. In addition, the same reference numerals designate the same constituent elements throughout the description of the drawings.

The term "comprises", "includes", or "has" described herein should be interpreted not to exclude other elements but to further include such other elements since the other elements may be present, unless mentioned otherwise.

FIG. 1 is a diagram showing the configuration of a display device 100 according to one or more embodiments of the present invention.

Referring to FIG. 1, the display device 100 includes a display panel 110, a gate driver 120, a source driver 130 and a threshold voltage sensing controller 140.

The display panel 110 includes a plurality of unit pixels (e.g., P1 to Pn). The plurality of unit pixels (e.g., P1 to Pn) may be arranged in a matrix.

Each of the unit pixels (e.g., P1 to Pn) may include a switching transistor TFT-S, a driving transistor TFT_D, a capacitor C, a threshold voltage sensing transistor TFT_V, and an organic light emitting diode (OLED).

The switching transistor TFT-S may include a gate that is connected to one of gate lines GL1 to GLn and source and drain terminals between one of data lines DL1 to DLn and a gate of the driving transistor TFT_D. The switching transistor TFT_S may deliver a data signal on the data line to the gate of the driving transistor TFT_D.

The driving transistor TFT_D may include a gate that is connected to the source of the switching transistor TFT_S and source and drain terminals between a first power supply PVDD and an anode of the OLED.

The driving transistor TFT_D may supply a driving current corresponding to the data signal from the switching transistor TFT_S to the OLED.

The capacitor C is between the gate of the driving transistor TFT_D and the first power supply. The capacitor C may store charge so that, when the driving transistor TFT_D is on (which may define one frame), the OLED continuously emits light during the one frame.

The OLED includes an anode (e.g., a P-type electrode and/or terminal) connected to a terminal (e.g., drain) of the driving transistor TFT_D and a cathode (e.g., an N-type electrode and/or terminal) connected to a second power supply PVSS.

The threshold voltage sensing transistor TFT_V includes source and drain terminals between one of the data lines and the anode of the OLED, and a gate controlled by the threshold voltage sensing controller.

The gate driver 120 drives the gate lines GL1 to GLn.

The source driver 130 includes output buffers BUF1 to BUFn configured to provide the data signals to the data lines, a reference voltage generator 106, and a threshold voltage sensing circuit 135 configured to sense the threshold voltage of one or more of the OLED.

Although not shown in FIG. 1, the source driver 130 may further include a shift register configured to generate a shift signal, a latch configured to store the data signal in response to the shift signal, a level shifter configured to change the voltage level of the data signal from the latch, and a digital-to-analog converter configured to convert digital data output from the level shifter into an analog signal. The output buffers BUF1 to BUFn buffer the analog signal output from the digital-to-analog converter and/or output the buffered analog signal to each of the data lines DL1 to DLn.

The reference voltage generator 106 may generate one or more reference voltages (e.g., VREF1, VREF2, VREF3, VREF12, VREF22 and/or VREF23) and supply at least one of the reference voltages to the sample and hold circuits SH1 to SHn. When the reference voltage generator 106 generates more than one reference voltage, the reference voltages may be different.

The threshold voltage sensing controller 140 generates a control signal configured to control the threshold voltage sensing transistor TFT_V.

For example, the threshold voltage sensing transistors TFT_V in a row of the display panel 110 may be simultaneously turned on by the threshold voltage sensing controller 140.

In one embodiment of FIG. 1, the threshold voltage sensing circuit 135 may be implemented in the source driver, but the invention is not limited thereto. In another embodiment, the threshold voltage sensing circuit 135 may be implemented on an integrated circuit (IC) separate from the source driver 130.

The threshold voltage sensing circuit 135 may include a sample and hold block 101, a multiplexer 102, an amplifier unit 103, and an analog-to-digital converter 104.

The threshold voltage sensing circuit 135 may further include a memory 105.

The sample and hold block 101 samples the threshold voltages of the OLEDs of the display panel 110 and stores the sampled threshold voltages.

The sample and hold block 101 may include a plurality of sample and hold circuits SH1 to SHn. Each of the plurality of sample and hold circuits SH1 to SHn is connected to one of the data lines to sample the threshold voltage of the OLED connected to one data line and to store the sampled threshold voltage.

Figure 2:
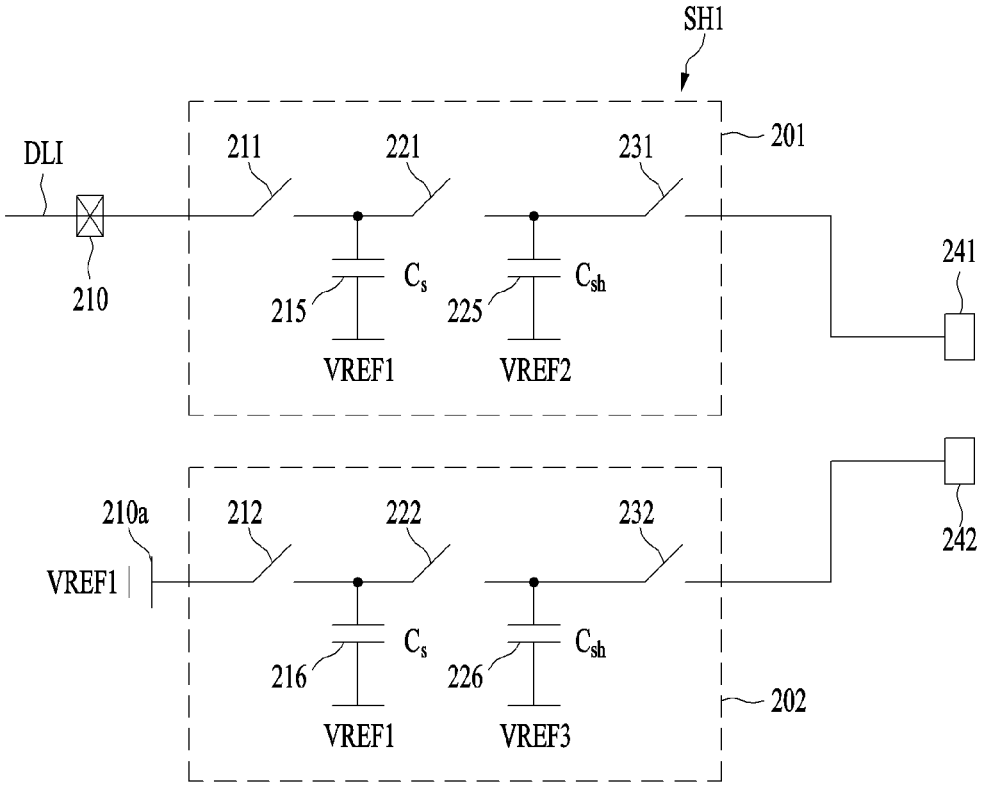
FIG. 2 is a diagram showing an embodiment of an exemplary first sample and hold circuit suitable for use in the display device of FIG. 1.

FIG. 2 is a diagram showing an embodiment of the first sample and hold circuit SH1, suitable for use in the display device shown in FIG. 1.

Referring to FIG. 2, the first sample and hold circuit SH1 includes a first sample and hold unit 201 and a second sample and hold unit 202.

The first sample and hold unit 201 samples the threshold voltage of the OLED connected to one of the data lines DL1 to DLn. The first sample and hold unit 201 may change the range of the sampled threshold voltage to the input voltage range of the amplifier unit 103 (FIG. 1).

The first sample and hold unit 201 includes a first input terminal 210, a first capacitor 215, a second capacitor 225, a first switching unit 211, 221 and 231, and a first output terminal 241.

The first input terminal 210 may be connected to one of the data lines DL1 to DLn.

The first capacitor 215 may be or comprise a first sampling capacitor, and the second capacitor may be or comprise a first charge sharing capacitor.

The first switching unit may be configured to selectively connect the first input terminal and one terminal of the first capacitor, the one terminal of the first capacitor and one terminal of the second capacitor, and/or the one terminal of the second capacitor and the first output terminal 241.

For example, the first switching unit includes a first switch 211, a second switch 221 and a third switch 231.

The first switch 211 serves to sample the threshold voltage of the OLED when closed.

The first switch 211 is between the first input terminal 210 and the one terminal of the first capacitor 215. The first switch 211 delivers the threshold voltage of the OLED to the first capacitor 215 from the data line DL1.

For example, one terminal of the first switch 211 may be connected to the first input terminal 210, and another terminal of the first switch 211 may be connected to the one terminal of the first capacitor 215.

The first capacitor 215 is between another terminal of the first switch 211 and a reference voltage VREF1 to sample the threshold voltage at the first input terminal 210.

The second switch 221 is between one terminal of the first capacitor 211 and one terminal of the second capacitor 225. The second switch 221 delivers the threshold voltage of the OLED sampled by the first capacitor 211 to the second capacitor 225.

The second capacitor 225 may be between one terminal of the second switch 221 and a reference voltage VREF2. The threshold voltage of the OLED sampled by the first capacitor 211 is delivered to the second capacitor 225 by the second switch 221, such that the threshold voltage of the OLED is charge-shared between the first capacitor 215 and the second capacitor 225. Thus, the second capacitor 225 may receive part of the charge on the first capacitor 215.

The third switch 231 is between the one terminal of the second capacitor 225 and the first output terminal 241, and the voltage on the second capacitor 225 is delivered to the first output terminal 241 when the third switch 231 is closed.

The second sample and hold unit 202 supplies a second component (or end) of a differential input to the amplifier unit 103 of FIG. 1. The second sample and hold unit 202 charge-shares the reference voltage VREF1 (supplied to a third capacitor 216) and a reference voltage VREF3 (supplied to a fourth capacitor 226) using the third capacitor 216 and the fourth capacitor 226, and outputs the second end of the differential signal when the switches in the switching unit are closed.

The second sample and hold unit 202 includes a second input terminal 201*a*, the third capacitor 216, the fourth capacitor 226, a second switching unit 212, 222 and 232, and a second output terminal 242.

The second input terminal 210*a* may receive (directly or capacitively) the reference voltage VREF1.

The third capacitor 216 may be or comprise a second sampling capacitor and the fourth capacitor 226 may be or comprise a second charge sharing capacitor.

The second switching unit may be configured to connect the second input terminal 210*a* and one terminal of the third capacitor 216, the one terminal of the third capacitor 216 and one terminal of the fourth capacitor 226, or the one terminal of the fourth capacitor 226 and the second output terminal 242.

For example, the second switching unit includes a fourth switch 212, a fifth switch 222 and a sixth switch 232.

The fourth switch 212 is between the reference voltage VREF1 and the one terminal of the third capacitor 216. The third capacitor 216 is between one terminal of the fourth switch 212 and the reference voltage VREF1. The fifth switch 222 is between the one terminal of the third capacitor 216 and one terminal of the fourth capacitor 226. The fourth capacitor 226 is between one terminal of the fifth switch 222 and the reference voltage VREF3. The sixth switch 232 is between the one terminal of the fourth capacitor 226 and the second output terminal 242.

The reference voltage VREF3 may be equal to or different from the reference voltage VREF2.

The operation of the fourth to sixth switches 212, 222 and 232 of the second sample and hold unit 202 may be synchronized with that of the first to third switches 211, 221 and 231 of the first sample and hold unit 201.

For example, the first and fourth switches 211 and 212 may be simultaneously turned on and off, the second and fifth switches 221 and 222 may be simultaneously turned on and off, and the third and sixth switches 231 and 232 may be simultaneously turned on and off.

For example, the sampling process or operation of the first sample and hold unit 201 may be performed simultaneously with the sampling process or operation of the second sample and hold unit 202, the charge sharing process or operation of the first sample and hold unit 201 may be performed simultaneously with the charge sharing process or operation of the second sample and hold unit 202, and the signal delivery process or operation of the first sample and hold unit 201 may be performed simultaneously with the signal delivery process or operation of the second sample and hold unit 202.

Each of the sample and hold circuits SH1 to SHn may be implemented to include the same configuration as the embodiment shown in FIG. 2, and the description of FIG. 2 is applicable thereto.

The multiplexer 102 (FIG. 1) selects one of the plurality of sample and hold circuits SH1 to SHn, and transmits the output of the selected circuit to the amplifier unit 103.

For example, n (n being a natural number greater than 1) sample and hold circuits SH1 to SHn may sample and hold the threshold voltages of a row of the OLEDs in the display panel 110 through the n channels or n data lines DL1 to DLn. Next, the multiplexer 102 may sequentially transmit at least one of the threshold voltages held by the sample and hold circuits SH1 to SHn to the first and second input terminals 251 and 252 of the amplifier unit 103.

Figure 3:
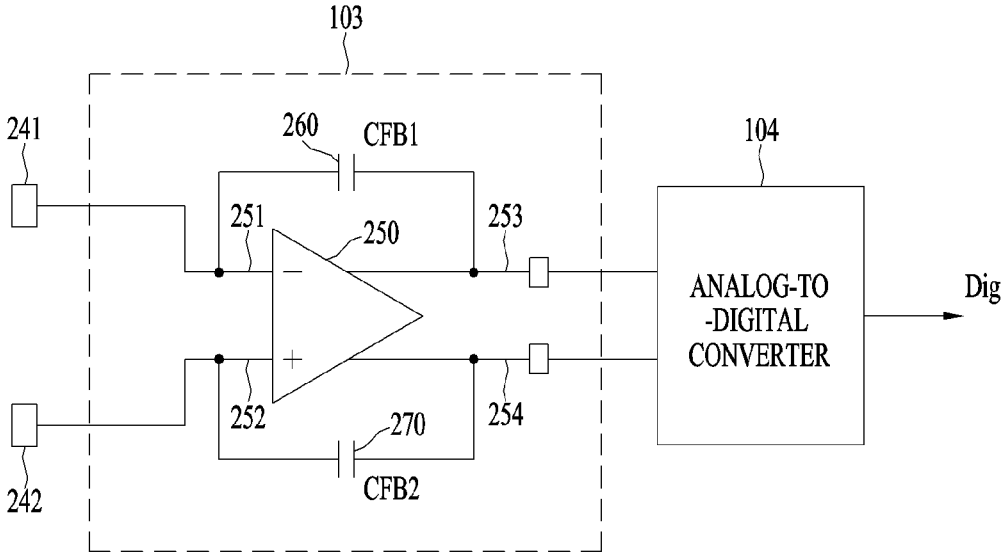
FIG. 3 is a diagram showing an embodiment of an exemplary amplifier and the analog-to-digital conversion unit as shown in FIG. 1.

FIG. 3 is a diagram showing an embodiment of the amplifier unit 103 and the analog-to-digital conversion unit 104 shown in FIG. 1. In FIG. 3, the multiplexer 102 between the sample and hold circuits SH1 to SHn and the amplifier unit 103 is omitted.

Referring to FIG. 3, the amplifier unit 103 may include an amplifier 250, a first feedback capacitor 260, and a second feedback capacitor 270.

The amplifier 250 may include a first input terminal 251, a second input terminal 252, a first output terminal 253, and a second output terminal 254. For example, the amplifier 250 may be a differential operational amplifier, without being limited thereto.

The first input terminal 251 of the amplifier 250 may be connected to the first output terminal 241 of the sample and hold circuit (e.g., SH1) selected by the multiplexer 102 of FIG. 1.

The second input terminal 252 of the amplifier 250 may be connected to the second output terminal 242 of the sample and hold circuit (e.g., SH1) selected by the multiplexer 102 of FIG. 1.

The first feedback capacitor 260 is between the first input terminal 251 and the first output terminal 253 of the amplifier 250, and the second feedback capacitor 270 is between the second input terminal 252 and the second output terminal 254 of the amplifier 250.

The amplifier 250 may amplify the differential signal input to the first input terminals 251 and 252 of the amplifier and output the amplified differential signal through at the first and second output terminals 253 and 254 of the amplifier 250.

For example, the amplifier 250 may differentially amplify the output on the first and second output terminals 241 and 242 of the sample and hold circuit (e.g., SH1 of FIG. 1).

Here, the output may be the output of the first and second sample and hold units 201 and 202 (FIG. 2).

The analog-to-digital converter 104 converts the analog output of the amplifier 250 and outputs a digital signal Dig. The digital signal Dig may have a digital value corresponding to the threshold voltage of the OLED.

The memory 105 (FIG. 1) stores the digital signal Dig from the analog-to-digital converter 104.

The source driver 130 may control the voltage or level of the data signal supplied to the OLED on the data line(s) based on the digital signal Dig stored in the memory 105. For example, the source driver 130 may control the voltage or level of the data signal on the data line(s) to compensate for a difference between the original threshold voltage of the OLED (or the digital value corresponding to the original threshold voltage of the OLED) and the digital value of the digital signal Dig stored in the memory 105. Accordingly, in embodiments of the invention, the OLED may be driven with constant brightness, regardless of any change in the threshold voltage of the OLED.

Figure 4:
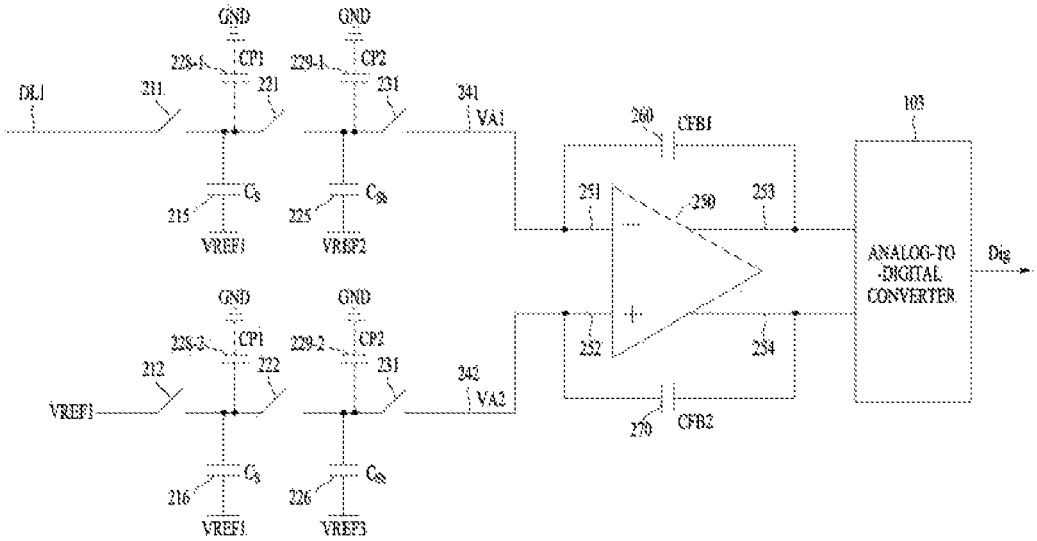
FIG. 4 is a diagram showing a parasitic capacitance component of the first sample and hold circuit shown in FIG. 2.

FIG. 4 is a diagram showing a parasitic capacitance component of the first sample and hold circuit (SH1 of FIG. 1).

Referring to FIG. 4, a first parasitic capacitor 228-1 may arise between the first capacitor 215 or the wire connected thereto and a ground voltage or ground potential GND, and a second parasitic capacitor 229-1 may arise between the second capacitor 225 or the wire connected thereto and the ground voltage or ground potential GND.

In addition, a third parasitic capacitor 228-2 may arise between the third capacitor 216 or the wire connected thereto and the ground voltage or ground potential GND, and a fourth parasitic capacitor 229-2 may arise between the fourth capacitor 226 and the ground voltage or ground potential GND.

A voltage VA1 at the first output terminal 241 of the sample and hold circuit SH1 may be expressed by Equation 1:

$$VA1 = \frac{(Vin - VR1)Cs + Vin \times Cp1 + VR2 \times Cp2}{Cs + Csh + Cp1 + Cp2} \quad \text{Equation 1}$$

Vin denotes the threshold voltage of the OLED received at the first input terminal 210 (FIG. 2) of the sample and hold circuit SH1, VR1 denotes the reference voltage VREF1, and VR2 denotes the reference voltage VREF2. The reference voltage VREF3 may be equal to the reference voltage VREF2.

Cp1 denotes the parasitic capacitance of each of the first parasitic capacitor 228-1 and the third parasitic capacitor 228-2, and Cp2 denotes the parasitic capacitance of each of the second parasitic capacitor 229-1 and the fourth parasitic capacitor 229-2.

Cs denotes the capacitance of each of the first capacitor 215 and the third capacitor 216, and Csh denotes the capacitance of each of the second capacitor 225 and the fourth capacitor 226.

For example, the capacitance of the first capacitor 215 and the capacitance of the third capacitor 216 may be equal, and the capacitance of the second capacitor 225 and the capacitance of the fourth capacitor 226 may be equal.

The voltage VA2 output at the second output terminal 242 of the sample and hold circuit SH1 may be expressed by Equation 2:

$$VA2 = \frac{VR1 \times Cp1 + VR2 \times Cp2}{Cs + Csh + Cp1 + Cp2} \quad \text{Equation 2}$$

The differential input voltage Vamp at the first and second input terminals 251 and 252 of the amplifier 250 in the amplifier unit 103 (FIG. 1) may be expressed by Equation 3:

$$Vamp = VA1 - VA2 = \frac{(Vin - VR1) \times (Cs + Cp1)}{Cs + Csh + Cp1 + Cp2} \quad \text{Equation 3}$$

In general, in the sample and hold circuit, as shown in FIG. 4, the parasitic capacitors Cp1 and Cp2 may arise, and an offset may occur in the sensed threshold voltage of the OLED due to the influence of the parasitic capacitors Cp1 and Cp2. Therefore, it may be difficult to accurately sense the threshold voltage, and reliability of the sensed threshold voltage may deteriorate.

However, each of the sample and hold circuits SH1 to SHn according to some embodiments includes a second sample and hold unit 202 having the same configuration as the first sample and hold unit 201, supplies the output of the first sample and hold unit 201 to the first input terminal 251 of the amplifier unit 103, and supplies the output of the second sample and hold unit 202 to the second input terminal 252 of the amplifier unit 103, thereby removing or cancelling the offset generated by the parasitic capacitors Cp1 and Cp2.

Referring to Equation 3, even when the gain of the amplifier unit 103 changes, the offset generated by the second parasitic capacitor Cp2 is cancelled, thereby reducing the influence of the offset generated by the parasitic capacitor. Accordingly, it is possible to improve the reliability and sensitivity of sensing the threshold voltage of the OLED of the display panel 110. Therefore, it is possible to drive the OLED with a desired brightness regardless of the change in threshold voltage.

Figure 5A:
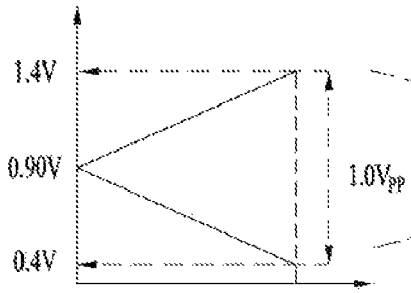
FIGS. 5A and 5B are diagrams illustrating an exemplary change in the output range of an amplifier according to the change in voltage of a reference voltage of the sample and hold circuit.
Figure 5B:
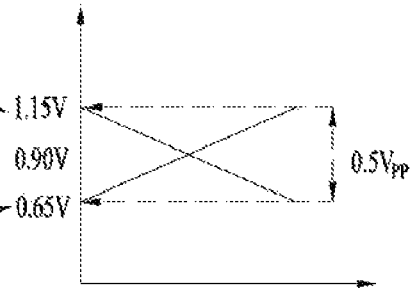

FIGS. 5A and 5B are diagrams illustrating a change in the output range of the amplifier according to the change in voltage of a reference voltage in or to the sample and hold circuit SH1.

FIG. 5A shows the output of the amplifier unit 103 when the reference voltage VREF2 and the reference voltage VREF3 of the sample and hold circuit SH1 are equal.

Referring to FIG. 5A, when the second and third reference voltages VREF2 and VREF3 in or to the sample and hold circuit (e.g., SH1) are a first voltage, the amplifier unit 103 (FIG. 4) may have an output range of 0.4[V] to 1.4[V]. Vpp refers to a peak-to-peak voltage.

FIG. 5B shows the output of the amplifier unit 103 (FIG. 4) when the reference voltage VREF2 and the reference voltage VREF3 of the sample and hold circuit SH1 are different from each other.

Referring to FIG. 5B, when the second reference voltage VREF2 of the sample and hold circuit (e.g., SH1) is a first voltage, and the third reference voltage VREF3 is a second voltage different from the first voltage, the amplifier unit 103 (FIG. 4) may have an output range of 0.65[V] to 1.15[V]. By supplying different reference voltages VREF3 and VREF2, it is possible to change the output range of the amplifier unit 103 (FIG. 4).

The sample and hold circuit SH1 shown in FIG. 2 includes a second sample and hold unit 202 having the same configuration as the first sample and hold unit 201. Accordingly, in the present invention, it is possible to reduce the offset of the threshold voltage of the OLED generated by the parasitic capacitors Cp1 and Cp2.

In addition, by supplying a third reference voltage VREF3 to the second sample and hold unit 202 different from the second reference voltage VREF2 to the first sample and hold unit 201, it is possible to control the output voltage range of the amplifier unit 103 (FIGS. 1 and/or 4) within the range of the analog-to-digital converter 104 (FIG. 1).

Figure 6:
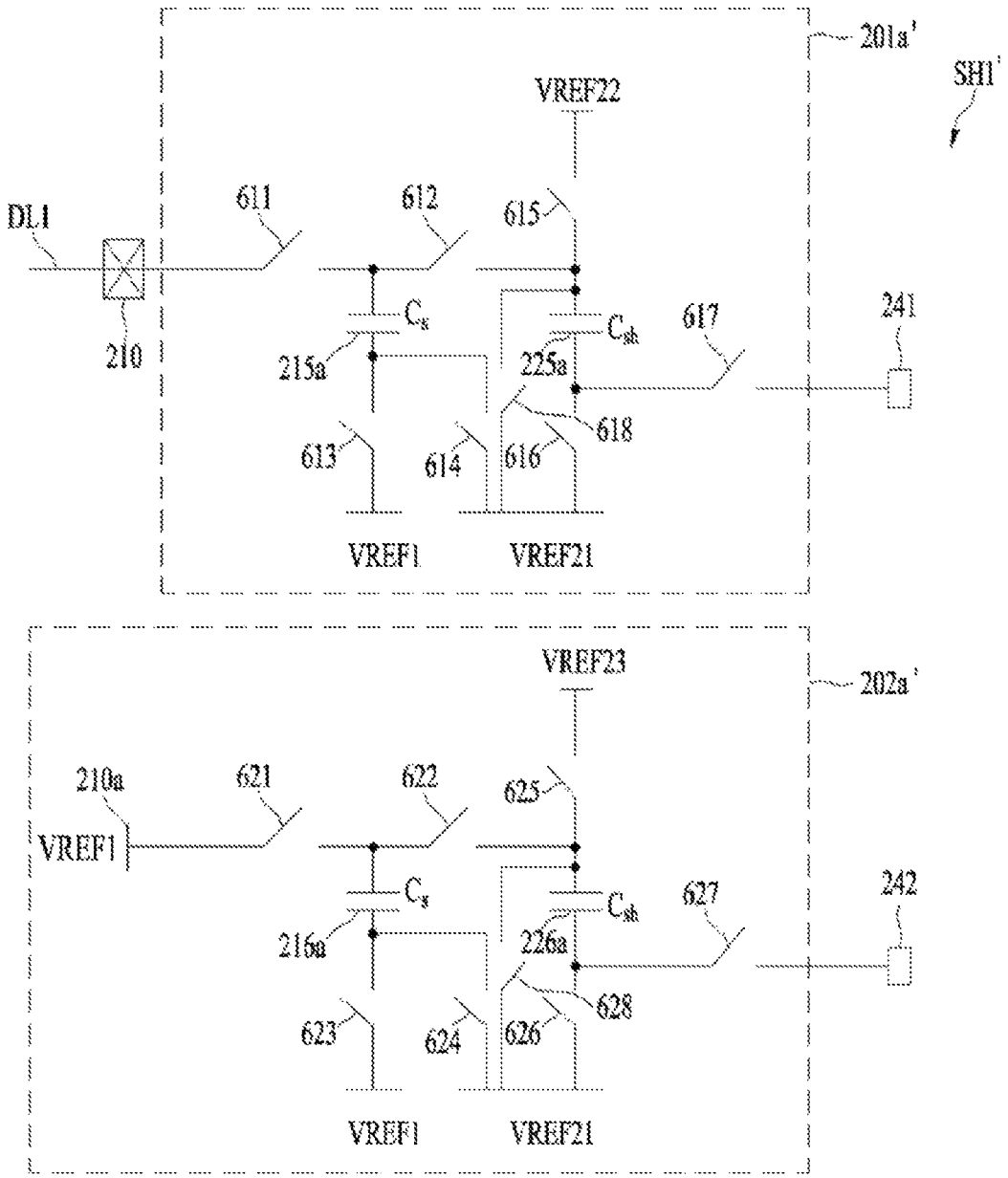
FIG. 6 is a diagram showing another embodiment of the first sample and hold circuit suitable for use in the display device of FIG. 1.

FIG. 6 is a diagram showing another embodiment SH1' of a first sample and hold circuit similar to the first sample and hold circuit SH1 of FIG. 1. The other sample and hold circuits SH2 to SHn of FIG. 1 may also have the same configuration of SH1'. The same reference numbers as FIG. 2 indicate the same components and a detailed description of the same components will be briefly described or omitted.

Referring to FIG. 6, the sample and hold circuit SH1' includes a first sample and hold unit 201*a*' and a second sample and hold unit 202*a*'.

The first sample and hold unit 201*a*' may include a first input terminal 210, first and second capacitors 215*a* and 225*a*, a first switching unit 611 to 617 and a first output terminal 241.

The threshold voltage of the OLED may be input to the first input terminal 210.

The first capacitor 215*a* may sample the threshold voltage of the OLED.

The second capacitor 225*a* may receive part of the charge from the voltage sampled by the first capacitor 215*a*.

The first switching unit may be configured to selectively connect the first input terminal 210 and the one terminal of the first capacitor 215*a*, the one terminal of the first capacitor 215*a* and the one terminal of the second capacitor 225*a*, another terminal of the first capacitor 215*a* and the reference voltage VREF1, the other terminal of the first capacitor 215*a* and the reference voltage VREF21, the one terminal of the second capacitor 225*a* and the reference voltage VREF22, another terminal of the second capacitor 225*a* and the first output terminal 241, and either terminal of the second capacitor 225*a* and the reference voltage VREF21.

The first output terminal 241 may output the charge-shared voltage to the second capacitor 225*a* when the switch 617 is closed.

The first switching unit may include first to seventh switches 611 to 617 and a first reset switch 618.

The first switch 611 may be between the first input terminal 210 connected to the data line DL1 and the one terminal of the first capacitor 215*a*. The one terminal of the first capacitor 215*a* may be connected to a second terminal of the first switch 611. The first terminal of the first switch 611 may be connected to the first input terminal 210.

The second switch 612 may be between one terminal of the first capacitor 611 and one terminal of the second capacitor 225*a*. The first terminal of the second switch 612 may be connected to one terminal of the first capacitor 215*a*, and another terminal of the second switch 612 may be connected to one terminal of the second capacitor 225*a*.

The third switch 613 may be between another terminal of the first capacitor 215*a* and the reference voltage VREF1.

The fourth switch 614 may be between another end of the first capacitor 215*a* and the reference voltage VREF21.

The fifth switch 615 may be between another end of the second capacitor 225*a* and the reference voltage VREF21.

The sixth switch 616 may be between the first terminal of the second capacitor 225*a* and the reference voltage VREF22.

The seventh switch 617 may be between the second terminal of the second capacitor 225*a* and the second output terminal 241.

The first reset switch 618 may be between the second terminal of the second capacitor 225*a* and the reference voltage VREF21.

The reference voltage VREF21 is less than the reference voltage VREF22.

In addition, the reference voltage VREF22 may be equal to or different from the reference voltage VREF23.

The second sample and hold unit 202*a* includes a second input terminal 210*a*, third and fourth capacitors 216*a* and 226*a*, a second switching unit and a second output terminal 242.

The second input terminal 210*a* may be connected to the reference voltage VREF1.

The second switching unit may be configured to selectively connect the second input terminal 210*a* and one terminal of the third capacitor 216*a*, the one terminal of the third capacitor 216*a* and one terminal of the fourth capacitor 226*a*, another terminal of the third capacitor 216*a* and the reference voltage VREF1, another terminal of the third capacitor 216*a* and the reference voltage VREF21, one terminal of the fourth capacitor 226*a* and the reference voltage VREF23, another terminal of the fourth capacitor 226*a* and the second output terminal 242, and either terminal of the fourth capacitor 225*a* and the reference voltage VREF21.

The second switching unit may include eighth to fourteenth switches 621 to 627 and a second reset switch 628.

The eighth switch 621 may be between the reference voltage VREF1 and one terminal of the third capacitor 216*a*. The ninth switch 622 may be between one terminal of the third capacitor 216*a* and one terminal of the fourth capacitor 226*a*. The tenth switch 623 may be between another end of the third capacitor 216*a* and the reference voltage VREF1. The eleventh switch 624 may be between the other terminal of the third capacitor 216*a* and the reference voltage VREF21.

The twelfth switch 625 may be between one terminal of the fourth capacitor 226*a* and the reference voltage VREF23. The thirteenth switch 626 may be between another terminal of the fourth capacitor 226*a* and the reference voltage VREF21. The fourteenth switch 627 may be between the other terminal of the fourth capacitor 226*a* and the second output terminal 242.

The capacitance of the first capacitor 215*a* may be equal to a capacitance of the third capacitor 216*a*, and the capacitance of the second capacitor 225*a* may be equal to a capacitance of the fourth capacitor 226*a*.

The first and third switches 611 and 613 and the eighth and tenth switches 621 and 623 may be simultaneously turned on and off.

The second switch 612, the fourth switch 614, the sixth switch 616, the ninth switch 622, the eleventh switch 624 and the thirteenth switch 626 may be simultaneously turned on and off.

The fifth and seventh switches 615 and 617 and the twelfth and fourteenth switches 625 and 627 may be simultaneously turned on and off.

Figure 7:
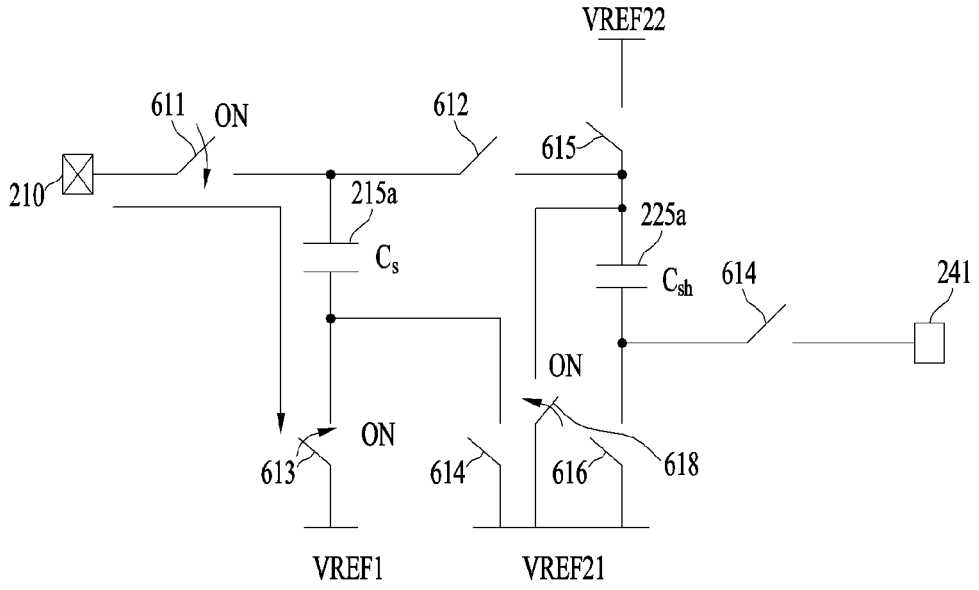
FIG. 7 is a diagram showing an exemplary sampling operation of the first sample and hold circuit shown in FIG. 6.

FIG. 7 is a diagram showing an exemplary sampling process or operation of the first sample and hold circuit 201*a*.

Referring to FIG. 7, the first switch 611 and the third switch 613 of the first sample and hold unit 201*a* of FIG. 6 are turned on, the second switch 612 and the fourth to seventh switches 614 to 617 are turned off, and the first reset switch 618 is turned on.

The sensed signal at the first input terminal 210 charges the first capacitor Cs1. The voltage on the second capacitor 225*a* is reset.

Although not shown in FIG. 7, the sampling process or operation of the second sample and hold unit 202*a* of FIG. 6 may be synchronized with the sampling process or operation of the first sample and hold unit 201*a*.

For example, simultaneously with the sampling process or operation of the first sample and hold unit 201*a*, the eighth switch 621 and the tenth switch 623 of the second sample and hold unit 202*a* may be turned on, the ninth switch 622 and the eleventh to fourteenth switches 624 to 627 may be turned off, and the second reset switch 628 may be turned on.

In the sampling process or operation, the first sample and hold unit 201*a* samples the threshold voltage of the OLED. However, since the voltages applied to both terminals of the third capacitor 216*a* of the second sample and hold unit 202*a* are equal, the third capacitor 216*a* does not sample a voltage, unlike the first capacitor 215*a* in the first sample and hold unit 201*a*.

Figure 8:
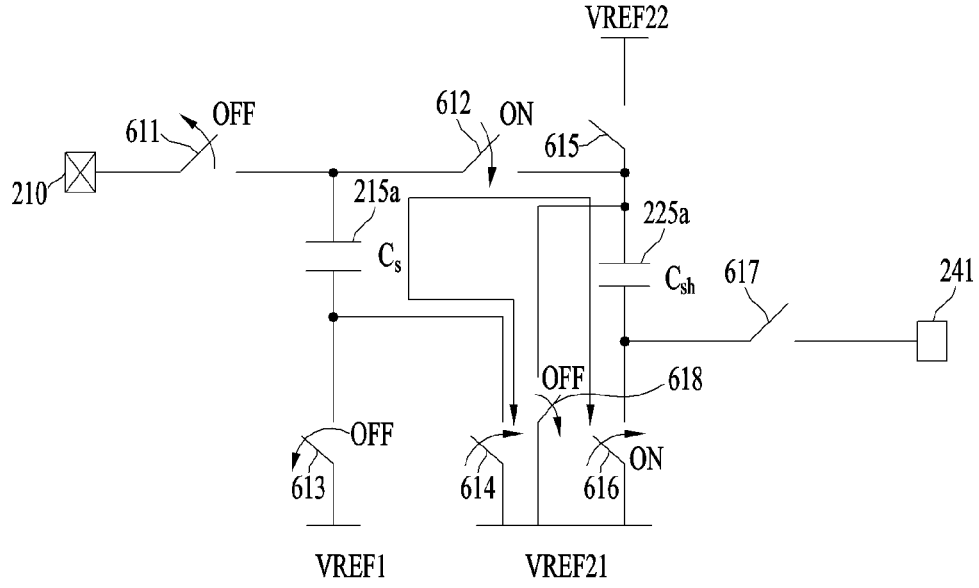
FIG. 8 is a diagram showing an exemplary charge sharing operation of the first sample and hold circuit shown in FIG. 6.

FIG. 8 is a diagram showing an exemplary charge sharing process or operation of the first sample and hold circuit 201*a*.

Referring to FIG. 8, when the first capacitor Cs1 is charged in the threshold voltage sampling process or operation, the charge sharing process or operation may be performed.

In the charge sharing process or operation, the first switch 611, the third switch 613, the fifth switch 615 and the seventh switch 617 of the first sample and hold unit 201*a* may be turned off, the second switch 612, the fourth switch 614 and the sixth switch 616 may be turned on, and the first reset switch 618 may be turned off.

Simultaneously with the charge sharing process or operation of the first sample and hold unit 201*a*, the eighth switch 621, the tenth switch 623, the twelfth switch 625 and the fourteenth switch 627 of the second sample and hold unit 202*a* may be turned off, the ninth switch 622, the eleventh switch 624 and the thirteenth switch 626 may be turned on, and the second reset switch 628 may be turned off.

The voltage in or on the first capacitor Cs1 may be shared with the second capacitor Cs2 through the charge sharing process or operation, and the voltage that is shared with or transferred to the second capacitor 225*a* may be less than the voltage in or on the first capacitor 215*a* in the sampling process or operation.

Since the reference voltage VREF21 is less than that of the reference voltage VREF22, it is possible to reduce the on-resistance of the second switch 612, the fourth switch 614 and the sixth switch 616.

In addition, the sixth and seventh switches 616 and 617 may be implemented by transistors having a lower withstand or resistance voltage (e.g., impedance) than the first to fifth switches 611 to 615.

The charge sharing process or operation of the second sample and hold unit 202*a* may be synchronized with the charge sharing process or operation of the first sample and hold unit 201*a*, and the description of the charge-sharing process or operation of the first sample and hold unit 201*a* is applicable thereto.

Since the reference voltage VREF21 is less than the reference voltage VREF22, it is possible to reduce the on-resistance of the ninth switch 622, the eleventh switch 624 and the thirteenth switch 626. In addition, the thirteenth and fourteenth switches 626 and 627 may be implemented by transistors having a lower withstand or resistance voltage (e.g., impedance) than the eighth to twelfth switches 621 to 625.

Figure 9:
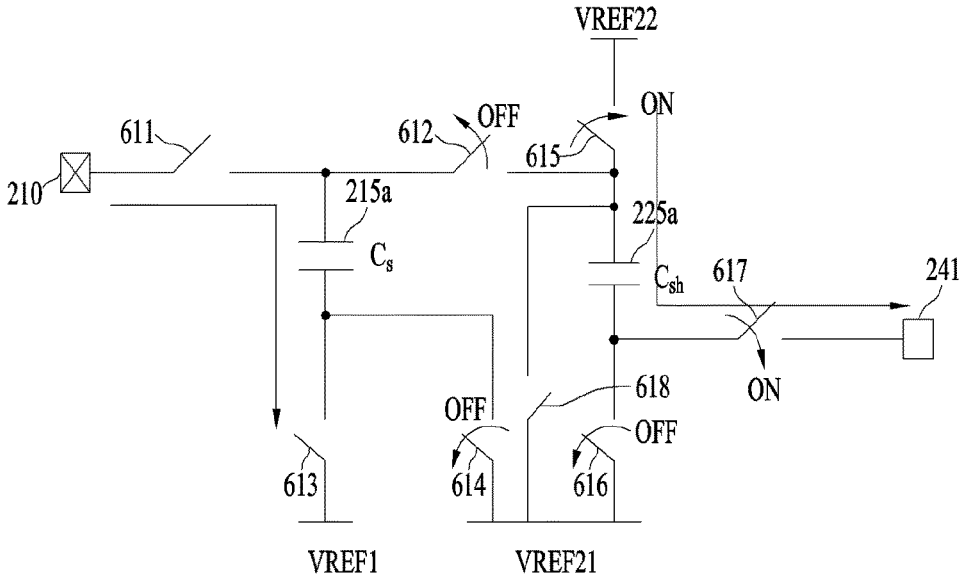
FIG. 9 is a diagram showing an exemplary signal delivery operation of the first sample and hold circuit of FIG. 6.

FIG. 9 is a diagram showing an exemplary signal delivery process or operation of the first sample and hold circuit 201*a* of FIG. 6.

Referring to FIG. 9, when the charge sharing process or operation is finished, a signal delivery process or operation for delivering or transferring the voltage that is on the second capacitor 225*a* to the first output terminal 241 may be performed.

In the signal delivery process or operation, the first to fourth switches 611 to 614 and the sixth switch 616 of the first sample and hold unit 201*a* may be turned off, the fifth switch 615 and the seventh switch 617 may be turned on, and the first reset switch 618 may be turned off.

In addition, simultaneously with the signal delivery process or operation of the first sample and hold unit 201*a*, the eighth to eleventh switches 621 and 624 and the thirteenth switch 626 of the second sample and hold unit 202*a* may be turned off, the twelfth switch 625 and the fourteenth switch 627 may be turned on, and the second reset switch 628 may be turned off.

In the charge sharing process or operation, the voltage on the second capacitor Cs2 is output through the first output terminal 241. Since the reference voltage VREF22 is greater than the reference voltage VREF21, the voltage delivered to the first output terminal 241 may change or differ from that after the reset operation and/or that on the second output terminal 242. Thus, the output voltage of the first sample and hold unit 201*a* delivered to the amplifier unit 103 is not less than the ground voltage or ground potential GND.

The fifth switch 615 and the seventh switch 617 of the first sample and hold unit 201*a* in the sample and hold circuits SH1 to SHn may be different from each other (e.g., in terms of the delay time and/or delivery time). Thus, a timing error may be generated.

To solve this problem, the fifth switch 615 is turned on, and the second capacitor 225*a* is connected to the reference voltage VREF22, thereby changing the charging voltage on the second capacitor 225*a* to a first level. Next, the seventh switch 617 may be turned on to output the voltage on the second capacitor 225*a* (which is at the first level) through the first output terminal 241.

In addition, in the second sample and hold unit 202*a*, the twelfth switch 625 may be turned on, the fourth capacitor 226*a* may be connected to the reference voltage VREF22 to reduce the charging voltage on the fourth capacitor 226*a*, and then the fourteenth switch 627 may be turned on to output the voltage on the fourth capacitor 226*a* to the second output terminal 242.

Figure 10:
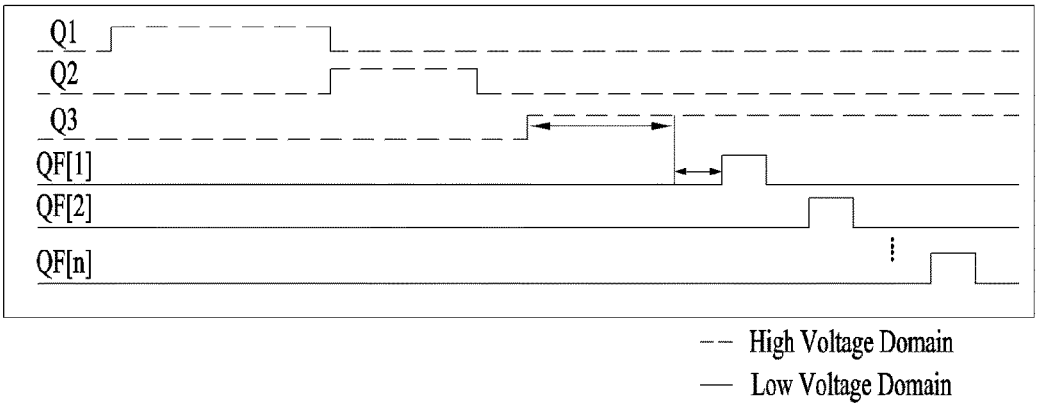
FIG. 10 is an exemplary timing diagram of signals in the sample and hold circuit of FIG. 6.

FIG. 10 is an exemplary timing diagram of signals in the sample and hold circuits SH1' to SHn' according to the schematic diagram of FIG. 6.

Referring to FIG. 10, Q1 is the control signal to the first and third switches 611 and 613 of each of the sample and hold circuits SH1' to SHn', Q2 is the control signal to the second switch 612, the fourth switch 614 and the sixth switch 616 of each of the sample and hold circuits SH1' to SHn', and Q3 is the control signal to the fifth switch 615 of each of the sample and hold circuits SH1' to SHn'. QF[1] may be the control signal to the seventh switch (or the fourteenth switch) of the first sample and hold circuit SH1 of FIG. 1, QF[2] may be the control signal to the seventh switch (or the fourteenth switch) of the second sample and hold switch SH2 of FIG. 1, and QF[n] may be the control signal to the seventh switch (or the fourteenth switch) of the n-th sample and hold switch SHn of FIG. 1.

According to the timing diagram of FIG. 10, it is possible to resolve or avoid an error or collision in the time to deliver the differential output signal to the amplifier unit 103 in the case of a difference in the delay time and/or the delivery time between the fifth and seventh switches 615 and 617 of the sample and hold circuits SH1 to SHn.

In general, the voltage input to the input terminal of the sample and hold circuit may be greater than that of the reference voltage connected to one terminal of the sampling capacitor. Accordingly, one or more of the transistors configured to implement the sample and hold circuit may use a high-voltage element (e.g., such as a high voltage gate oxide layer) or device (e.g., a high voltage transistor), and one or more of the transistor(s) configured to implement the amplifier unit may also use a similar or identical high-voltage element or device to improve device reliability.

As described with reference to FIGS. 7 to 9, during the sample and hold process or operation, a high voltage is applied to one terminal of the first capacitor 215*a* and one terminal of the second capacitor 225*a*, but a low voltage is applied to the node between the other terminal of the second capacitor 225*a* and the seventh switch 617. Accordingly, in some embodiments, the fifth and seventh switches 615 may comprise or be implemented by a low-voltage transistor, and the amplifier unit 103 may comprise or be implemented by a low-voltage element.

For example, the withstand or resistance voltage (e.g., impedance) of the transistor configured to implement each of the fifth and seventh switches may be lower than that of the transistor configured to implement each of the first to fourth transistors and the sixth transistor.

The second sample and hold unit 202*a* may be implemented in each of the sample and hold circuits SH1' to SHn', although their implantation is not necessary.

For example, in another embodiment, the sample and hold block 101 of FIG. 1 may include a plurality of first sample and hold units 201*a* of FIG. 2 and one or more second sample and hold units 202*a* of FIG. 2, instead of the sample and hold circuits SH1' to SHn'.

To sense the threshold voltages of the OLEDs through the plurality of data lines, the sample and hold block 101 may share a common second sample and hold unit 202*a* or 202*a*' among all of the first sample and hold units 201*a* and/or 201*a*', thereby reducing the circuit area of the sample and hold block 101.

After amplifying the output of one of the plurality of first sample and hold units 201*a* and before amplifying the output of another first sample and hold unit, the amplifier unit 103 is reset to eliminate any influence from the previous amplification process or operation. Accordingly, the amplifier unit 103 alternately performs the amplification process or operation and a reset process or operation.

After the reset process or operation of the amplifier unit 103, to perform the threshold voltage sensing process or operation of the OLED that is connected to a next data line, the sample and hold block 101 may include two second sample and hold units 202*a* (e.g., a primary second sample and hold unit and a secondary second sample and hold unit). Each of the primary and secondary sample and hold units may have the same configuration as the second sample and hold unit 202*a* shown in FIG. 2 or 202*a*' of FIG. 6.

For example, the number of second sample and hold units 202*a* or 202*a*' included in the threshold voltage sensing circuit may be less than the number of the first sample and hold units 201*a* or 201*a'*.

The multiplexer 102 may selectively connect the output terminals 242 of the primary second sample and hold unit and the secondary second sample and hold unit to the second input terminal 251 of the amplifier unit 103.

For example, a plurality of first sample and hold units according to yet another embodiment may share the primary second sample and hold unit and/or the secondary second sample and hold unit to perform the threshold voltage sensing process or operation.

For example, the secondary second sample and hold unit may perform a transmission process or operation, and the amplifier unit 103 may perform a first amplification process or operation. At the same time, the primary second sample and hold unit may perform the sampling process or operation.

In addition, when the amplifier unit 103 performs the reset process or operation after the first amplification process or operation, the primary second sample and hold unit may perform the charge sharing process or operation, and the secondary second sample and hold unit may the perform sampling process or operation.

In addition, the primary second sample and hold unit may perform the transmission process or operation and the amplifier unit 103 may perform a second amplification process or operation, and at the same time, the secondary second sample and hold unit may perform the charge sharing process or operation.

The above-described transmission process or operation, the sampling process or operation, and the charge sharing process or operation may be equal to processes or operations described with reference to FIGS. 7 to 9.

Through such processes or operations, it is possible to perform the next sensing process or operation without a waiting period or delay time when resetting the amplifier unit 103. Accordingly, it is possible to reduce the time required to sense the threshold voltage of the OLED and to secure a timing margin.

According to one or more embodiments, it is possible to reduce an offset caused by a parasitic capacitor of a sample and hold circuit and to improve reliability and sensitivity in sensing the threshold voltage of an organic light emitting diode (OLED).

Features, structures, effects, and the like as described above in various embodiments are included in at least one embodiment of the present invention and should not be limited to only one embodiment. In addition, the features, structures, effects, and the like described in the respective embodiments may be combined or modified even with respect to the other embodiments by those skilled in the art. Accordingly, contents related to these combinations and modifications should be construed as within the scope of the present invention.

What is claimed is:

1. A circuit configured to sense a threshold voltage of an organic light emitting diode (OLED) of a display panel, the circuit comprising:

a first sample and hold circuit including a first input terminal configured to receive the threshold voltage of the OLED, a first capacitor configured to sample the threshold voltage of the OLED, a second capacitor configured to charge-share a voltage on or from the first capacitor, and a first output terminal configured to output a voltage on or from the second capacitor; and an amplifier including a first amplifier input terminal connected to the first output terminal of the first sample and hold circuit, wherein the first sample and hold circuit includes a first set of switches configured to selectively connect and disconnect the first input terminal and a first terminal of the first capacitor, the first terminal of the first capacitor and a first terminal of the second capacitor, a second terminal of the first capacitor and a first reference voltage, the second terminal of the first capacitor and a second reference voltage, a second terminal of the second capacitor and a second reference voltage, the first terminal of the second capacitor and a third reference voltage, and the second terminal of the second capacitor and the first output terminal.

2. The circuit according to claim 1, wherein the first set of switches further includes:

a first switch between the first input terminal and the first terminal of the first capacitor;

a second switch between the first terminal of the first capacitor and the first terminal of the second capacitor;

a third switch between the second terminal of the first capacitor and the first reference voltage;

a fourth switch between the second terminal of the first capacitor and the second reference voltage;

a fifth switch between the second terminal of the second capacitor and the second reference voltage;

a sixth switch between the first terminal of the second capacitor and the third reference voltage; and a seventh switch between the second terminal of the second capacitor and the first output terminal.

3. The circuit according to claim 1, where in second reference voltage is less than the third reference voltage.

4. The circuit according to claim 1, further comprising a second sample and hold circuit including:

a second input terminal connected to the first reference voltage;

a third capacitor;

a fourth capacitor;

a second output terminal; and a second set of switches configured to selectively connect and disconnect the second input terminal and a first terminal of the third capacitor, the first terminal of the third capacitor and a first terminal of the fourth capacitor, a second terminal of the third capacitor and the first reference voltage, the second terminal of the third capacitor and the second reference voltage, either terminal of the fourth capacitor and the second reference voltage, the first terminal of the fourth capacitor and a fourth reference voltage, and the second terminal of the fourth capacitor and the second output terminal.

5. The circuit according to claim 4, wherein the second set of switches includes:

an eighth switch between the second input terminal and first terminal of the third capacitor;

a ninth switch between the first terminal of the third capacitor and the first terminal of the fourth capacitor;

a tenth switch between the second terminal of the third capacitor and the first reference voltage;

an eleventh switch between the second terminal of the third capacitor and the second reference voltage;

a twelfth switch between the first terminal of the fourth capacitor and the fourth reference voltage;

a thirteenth switch between the second terminal of the fourth capacitor and the second reference voltage; and a fourteenth switch between the second terminal of the fourth capacitor and the second output terminal.

6. The circuit according to claim 4, wherein the amplifier further includes:

a second amplifier input terminal connected to the second output terminal; and first and second amplifier output terminals, wherein the amplifier input terminals and output an amplified signal on the first and second amplifier output terminals.

7. The circuit according to claim 6, wherein the amplifier further includes:

a first feedback capacitor between the first amplifier input terminal and the first amplifier output terminal; and a second feedback capacitor between the second amplifier input terminal and the second amplifier output terminal.

8. The circuit according to claim 6, further comprising an analog-to-digital converter configured to convert the amplified signal a digital signal.

9. The circuit according to claim 8, further comprising a memory configured to store the digital signal.

10. The circuit according to claim 4, wherein:

a capacitance of the first capacitor is equal to a capacitance of the third capacitor, and a capacitance of the second capacitor is equal to a capacitance of the fourth capacitor.

11. The circuit according to claim 4, wherein:

the first and third switches and the eighth and tenth switches are configured to be connected and disconnected simultaneously, the second, fourth, sixth, ninth, eleventh and thirteenth switches are configured to be connected and disconnected simultaneously, and the fifth and seventh switches and the eleventh and fourteenth switches are configured to be connected and disconnected simultaneously.

12. The circuit according to claim 4, wherein the first and second sample and hold circuits are configured to sample the threshold voltage of the OLED by (i) connecting the first switch, the third switch, the eighth switch and the tenth switch and (ii) disconnecting the second switch, the fourth to seventh switches, the ninth switch and the eleventh to fourteenth switches.

13. The circuit according to claim 11, wherein the first and second set of switches are configured to share a voltage on the first and third capacitors by (i) connecting the second and ninth switches, the fourth and eleventh switches and the sixth and thirteenth switches and (ii) disconnecting the first and eighth switches, the third and tenth switches and the fifth and twelfth switches and the seventh and fourteenth switches.

14. The circuit according to claim 13, wherein the first and second sample and hold circuits are configured to transfer or deliver a signal to the first and second output terminals by (i) connecting the fifth and twelfth switches and the seventh and fourteenth switches and (ii) disconnecting the first to fourth switches, the eighth to eleventh switches and the sixth and thirteenth switches.

15. A circuit configured to sense a threshold voltage of an organic light emitting diode (OLED) of a display panel, the circuit comprising:

a first input terminal configured to receive a threshold voltage the OLED;

a first capacitor configured to sample the threshold voltage of the OLED;

a second capacitor configured to charge-share a voltage on or from by the first capacitor;

a first output terminal configured to output a voltage on or from the second capacitor;

a first set of switches configured to selectively connect and disconnect the first input terminal and a first terminal of the first capacitor, the first terminal of the first capacitor and a first terminal of the second capacitor, a second terminal of the first capacitor and a first reference voltage, the second terminal of the first capacitor and a second reference voltage, a second terminal of the second capacitor and the second reference voltage, the first terminal of the second capacitor and a third reference voltage, and the second terminal of the second capacitor and the first output terminal; and an amplifier including a first input terminal connected to the first output terminal.

16. A display device comprising:

a display panel including (i) a plurality of unit pixels and (ii) a plurality of gate lines and a plurality of data lines connected to the plurality of unit pixels, each unit pixel respectively including an organic light emitting diode (OLED); and a source driver including a threshold voltage sensing circuit configured to sense a threshold voltage of each of the plurality of OLEDs, wherein the threshold voltage sensing circuit includes:

a plurality of sample and hold circuits configured to sample and hold the threshold voltage of each of the plurality of OLEDs through the data lines; and an amplifier configured to amplify outputs of the sample and hold circuits, each of the plurality of sample and hold circuits includes:

a first sample and hold circuit including a first input terminal connected to one of the data lines, a first capacitor configured to sample the threshold voltage of the OLED, a second capacitor configured to charge-share a voltage on or from the first capacitor, a first output terminal configured to output a voltage on or from the second capacitor, and a first set of switches;

the amplifier includes a first input terminal connected to the first output terminal, and the first set of switches is configured to selectively connect and disconnect the first input terminal and a first terminal of the first capacitor, the first terminal of the first capacitor and a first terminal of the second capacitor, a second terminal of the first capacitor and a first reference voltage, the second end of the first capacitor and a second reference voltage, a second terminal of the second capacitor and the second reference voltage, the first terminal of the second capacitor and a third reference voltage, and the second terminal of the second capacitor and the first output terminal.

17. The display device according to claim 16, wherein the first set of switches further includes:

a first switch between the first input terminal and the first terminal of the first capacitor;

a second switch between the first terminal of the first capacitor and the first terminal of the second capacitor;

a third switch between the second terminal of the first capacitor and the first reference voltage;

a fourth switch between the second terminal of the first capacitor and the second reference voltage;

a fifth switch between the second terminal of the second capacitor and the second reference voltage;

a sixth switch between the first terminal of the second capacitor and the third reference voltage; and a seventh switch between the second terminal of the second capacitor and the first output terminal.

18. The display device according to claim 16, wherein the threshold voltage sensing circuit further includes a multiplexer configured to select one of the plurality of sample and hold circuits and provide an output of the selected sample and hold circuit to a first input terminal of the amplifier.

19. The display device according to claim 16, wherein the threshold voltage sensing circuit further includes:

an analog-to-digital converter configured to convert a signal from the amplifier to a digital signal; and a memory configured to store the digital signal.

20. The display device according to claim 18, wherein the threshold voltage sensing circuit further includes a primary second sample and hold circuit and a secondary second sample and hold circuit, and each of the primary second sample and hold circuit and the secondary second sample and hold circuit includes:

a second input terminal connected to the first reference voltage;

a third capacitor and a fourth capacitor; a second output terminal; and a second set of switches configured to selectively connect and disconnect the second input terminal and a first end of the third capacitor, the first terminal of the third capacitor and a first terminal of the fourth capacitor, a second terminal of the third capacitor and the first reference voltage, the second terminal of the third capacitor and the second reference voltage, a second terminal of the fourth capacitor and the second reference voltage, the first terminal of the fourth capacitor and a fourth reference voltage, or the second terminal of the fourth capacitor and the second output terminal.

* * * * *